United States Patent [19]

Berkstresser, Jr. et al.

[11] 4,339,056

[45] Jul. 13, 1982

[54] LID TIDY

[76] Inventors: Harold Berkstresser, Jr., c/o George Spector, 3615 Woolworth Bldg., 233 Broadway; George Spector, 3615 Woolworth Bldg. 233 Broadway, both of New York, N.Y. 10007

[21] Appl. No.: 203,065

[22] Filed: Nov. 3, 1980

[51] Int. Cl.[3] ..... B65D 55/16

[52] U.S. Cl. ..... 220/375

[58] Field of Search ..... 220/1 T, 318, 231, 375; 215/306; 292/258, 288

[56] References Cited

U.S. PATENT DOCUMENTS

| | | | |
|---|---|---|---|
| 2,155,329 | 4/1939 | Perdue | 220/375 |
| 3,158,393 | 11/1964 | King | 292/288 |
| 3,949,897 | 4/1976 | Shaw et al. | 220/231 |

*Primary Examiner*—George T. Hall

[57] ABSTRACT

A mechanism for tethering a removable cover to a container so that the cover does not become lost therefrom; the mechanism consisting of a flexible elongated strap which at one end includes a means for connecting to the cover, and which at the other end has means for connection to the container.

3 Claims, 8 Drawing Figures

10
11
12
13
14
15
16
17
18
19
20
21
22
23
24
25
26
30
31
32
33
34
35
36
37
38

LID TIDY

This invention relates generally to tethering devices.

A principal object of the present invention is to provide a tethering device which allows movement between a cover and a container so that the cover from therefrom but which keeps the cover from being disconnected and lost therefrom.

Another object is to provide tethering device which can be designed so to be suitable for tethering removable covers on either medicine bottles, vitamin containers, toothpaste tubes, or any other resealable container such as a garbage can or the like.

Still another object is to provide a tethering device which thus eliminates the aggrevation of a lost lid or cover for a container.

Other objects are to provide a Lid Tidy which is simple in design, inexpensive to manufacture, rugged in construction, easy to use and efficient in operation.

These and other objects will be readily evident upon a study of the following specifications and the accompanying drawing wherein.

Figures 1, 2, 3, 4, 5, 6, 7, 8:
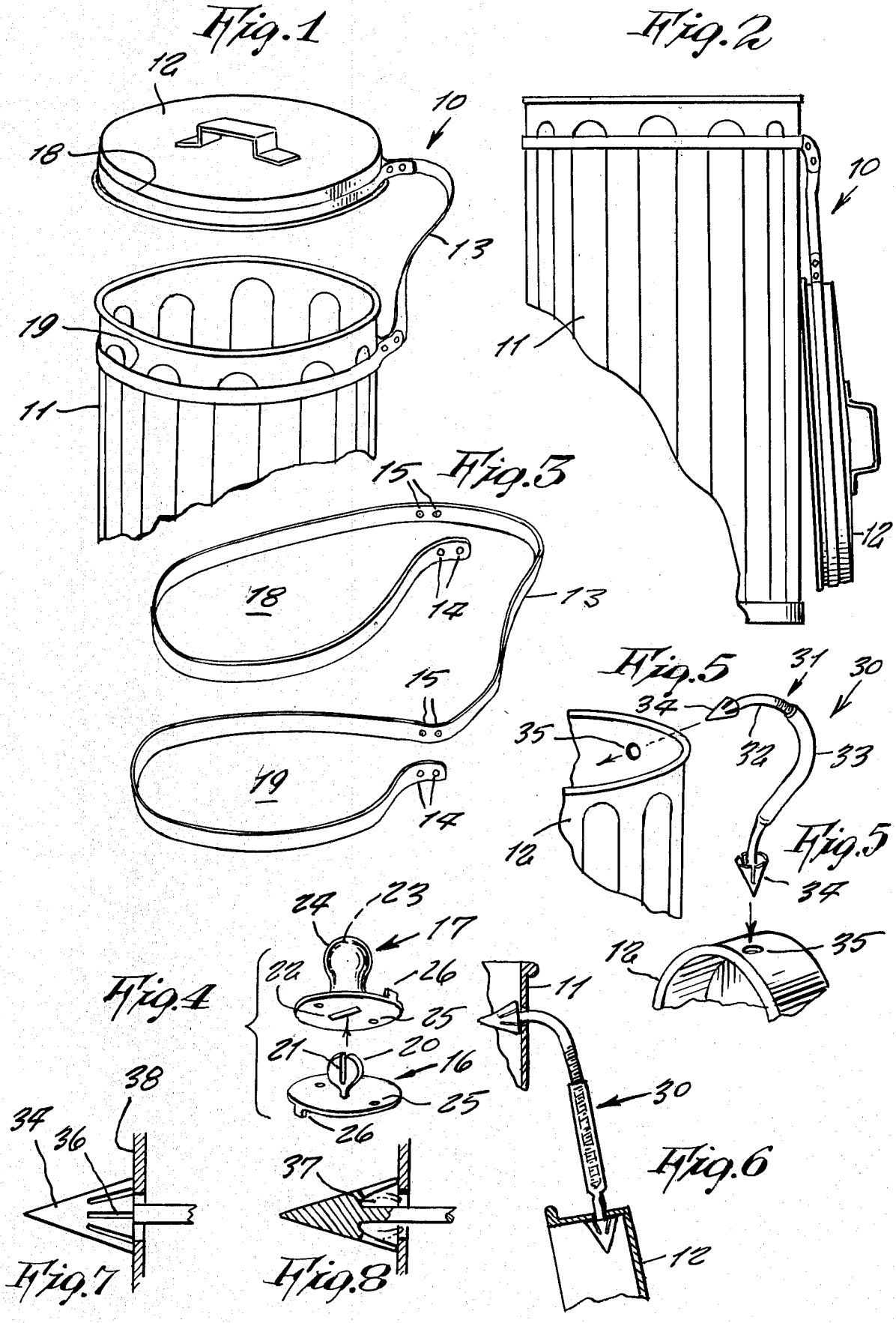
FIG. 1 is a perspective view of one design of the invention which snaps around the can lid so that it needs no holes drilled in the can or lid for attachment.
FIG. 2 shows the invention of FIG. 1 holding a lid hanging down.
FIG. 3 shows the invention of FIG. 1 alone.
FIG. 4 shows a new design of snap fasterner for use with the invention of FIG. 1, which blocks the invention from opening up accidently when given a one-half turn.
FIG. 5 shows another design in which opposite ends of the all-rubber tie piece taper connically so to snap into holes drilled in the can and lid for quick and easy attachment.
FIG. 6 shows the tie piece of FIG. 5 holding a hanging lid.
FIG. 7 is a detail of the tie piece of FIG. 5.
FIG. 8 shows it in cross section and shows how it can be inward flexed when wanted removed from a lid or can.

Referring now to the drawing in greater detail, and more particularly to FIGS. 1 through 4 thereof at this time, the reference numeral 10 represents a Lid Tidy which in this illustrated example relates to a garbage can 11 having a cover or lid 12 tethered away by a high wind or misplaced when the can is being dumped. The tethering device or Lid Tidy 10 includes an elongated strap 3 made of a flexible, durable, inexpensive material such a plastic and which includes a pair of openings 14 at each end and also two pairs of openings 15 along longitudinally intermediate portions thereof for receiving interconnecting fasteners 16 and 17 therebetween in order to form loops 18 and 19 at each end of the strap so to be fitted tightly around a perepheral side of the lid and the can.

The fastener 16 in this invention includes a circular, flat projection 20 having a central split 21 so that the width thereof can be squeezed together in order to allow snapping the projection through an entry slot 22 of shorter length and which is on underside of fastener 17, the elongated entry slot 22 communicating with a spherical dome 24 formed integrally upon the fastener 16 inside the fastener 17 and then giving it a short rotation, the fasteners are rigidly secured together and cannot be pulled apart even under a strong pulling force. The fasteners include mounting holes 25 for rigidly affixing them to the strap in relatively disaligned positions so that they will not accidently pull apart. Tabs 26 on the fasteners aid to forcibly twist the strap and fasteners so the fasteners align and allow separation. The fasteners may be made of metal or a hard plastic.

In FIGS. 5 through 8 another design of Lid Tidy 30 includes flexible strap 31 comprised of soft plastic thongs 32 and 33 that are screw threaded together so to be adjustably extendable, one thong 33 being tubular so to receive the other thong therein. Each thong at its one end is shaped with a conical head 34 drilled into the can 11 and lid 12. The flaring conically enlarged end of the head is longitudinally split until slits 36 so that it may be squeezed together when squeezed through the hole 35, as shown by the dotted lines in FIG. 8. A hollow recess slits a rear of the head thus together with the slits transformer of the enlarged end into tabs 38 that bear against a surface 39 of the can lid.

While various changes may be made in the detail construction, it is understood that such changes will be within the spirit and scope of the present invention as in defined by the appended claims.

What is claimed is:

1. A tethering device attached between a removable cover and refuse container of similar diameter comprising in combination a flexible elongated strap with means at opposite ends for firm securement to said cover and container, said means having flat surfaces adapted to contact said cover and container along a surface wider than the strap thickness, wherein said means comprises said ends being made into a loop shape and secured in said shape by interconnecting transverse snap fasteners one of which includes a flat tab receivable through a narrow slot into a spherical interior of a dome integral with the other said fastener, wherein said tab is integrally compressible to fit into said slot.

2. The combination as set forth in claim 1, wherein said strap comprises interconnected thongs longitudinally adjustable relative to each other each of which has an outer end having a conical head including a recessed rear flaring end heads being radially compressible to fit transversely through openings through the cover and container thereafter expanding to engage said can and cover retainingly.

3. The combination of claim 2, wherein said rear flaring end includes an inner recess surrounding an axial stem portion and a plurality of spaced slots forming radially compressible tabs.

* * * * *